United States Patent [19]

Fermaglich et al.

[11] Patent Number: 4,743,008

[45] Date of Patent: May 10, 1988

[54] INFANT EXERCISER

[76] Inventors: Daniel R. Fermaglich; Lois F. Fermaglich, both of 9 Van Duyne Rd., Mountain Lakes, N.J. 07046

[21] Appl. No.: 944,240

[22] Filed: Dec. 19, 1986

[51] Int. Cl.[4] ..... A63B 23/06

[52] U.S. Cl. ..... 272/69; 272/70; 297/137

[58] Field of Search ..... 272/114, 115, 70, 70.3, 272/70.4, 69, 39, 33 A, 40, 42, 43; 297/5, 137; 135/65, 66, 67, 68, 71, 73

[56] References Cited

U.S. PATENT DOCUMENTS

| | | | |
|---|---|---|---|
| 839,681 | 12/1906 | Voigt | 272/70 |
| 875,377 | 12/1907 | Pilia et al. | 272/69 |
| 2,665,742 | 1/1954 | Starysky | 297/137 |
| 2,697,478 | 12/1954 | McKinney | 272/33 R |
| 2,910,111 | 10/1959 | Hansburg | 297/137 |
| 3,130,814 | 4/1964 | Del Aquila | 272/70.3 |
| 3,279,576 | 10/1966 | Kempel | 272/70.3 |
| 3,454,272 | 7/1969 | Elkington et al. | 297/137 |
| 3,747,596 | 7/1973 | Mills | 128/134 |
| 4,204,673 | 5/1980 | Speer, Sr. | 272/69 |
| 4,334,695 | 6/1982 | Ashby | 280/228 |

FOREIGN PATENT DOCUMENTS

| | | | |
|---|---|---|---|
| 734490 | 8/1932 | France | 272/69 |

*Primary Examiner*—Richard J. Apley
*Assistant Examiner*—Howard Flaxman
*Attorney, Agent, or Firm*—Ralph W. Selitto, Jr.

[57] ABSTRACT

An infant exerciser includes a frame adapted for stationary placement on a floor or other support surface and a seat and treadmill assembly revolvably mounted on the frame. The treadmill is suspended beneath the seat so that an infant supported in the seat can exercise its legs by walking on the treadmill without moving the frame. By revolving the seat and treadmill assembly, an infant can change his or her field of view and interact with the surrounding environoment, while simultaneously practicing to walk or othewise exercising through the use of the treadmill.

26 Claims, 3 Drawing Sheets

INFANT EXERCISER

FIELD OF THE INVENTION

The present invention relates, in general, to an infant exerciser, and, more particularly, to an infant exerciser having a revolvable seat and treadmill assembly which permits an infant to exercise its legs and to interact with its environment while the exerciser remains stationary.

BACKGROUND OF THE INVENTION

Devices for training babies to walk have been proposed in the past. For instance, U.S. Pat. No. 839,681 discloses a baby walker in which a seat is slidably mounted on guide rails supported on a stationary frame. A baby seated in the seat can walk from one end of the guide rails to an opposite end on a fastboard or treadway. Such a device, however, is adapted for unidirectional travel only. That is, once the baby reaches the end of the treadway, the seat must be returned to the other end, thereby requiring assistance from older children or adults. Also, the baby can not turn around or change its field of view while seated.

U.S. Pat. No. 875,377 discloses a baby walker in which a seat is revolvably mounted on a carriage adapted to move back and forth along a pair of support rods. A baby seated in the seat can walk from one end of the support rods to the other end on a platform. Once the baby reaches the opposite end of the platform, he or she can turn the seat around and then walk back to the other end. Because the baby actually walks along the platform, the baby walker is, out of necessity, comparatively large and cumbersome. Although the mobility of the baby walker is enhanced by trucks (i.e., roller assemblies) provided at the bottom of the walker, such mobility poses a potential hazard in that the walker can be accidentally or unintentionally moved close to stairs or dangerous appliances, such as stoves and heaters.

French Patent No. 734,490 discloses a baby walker having a seat suspended in a mobile frame. Rollers are mounted below the seat such that the feet of a baby supported in the seat can contact the rollers, rather than a floor or similar support surface on which the frame sits. The baby can exercise by moving his legs and feet in a walking motion on the rollers. Because the rollers are exposed, the baby's toes or feet can get caught therebetween. The mobility of the walker also poses a potential hazard in that the walker, like the walker disclosed in U.S. Pat. No. 875, 377, can be accidentally or unintentionally moved close to stairs or dangerous appliances, such as stoves and heaters. Furthermore, inasmuch as the seat and rollers are fixed within the frame, the baby cannot face a different direction without the entire frame being reoriented, thereby substantially reducing the ability of the baby to interact with its surrounding environment.

SUMMARY OF THE INVENTION

The problems and disadvantages of the prior art devices discussed above are overcome in accordance with the present invention by providing an infant exerciser with a seat and treadill assembly which is rotatably mounted on a stationary frame. More particularly, the seat is sized and shaped so as to permit an infant to sit thereon. The treadmill is positioned below the seat such that the infant can walk on the treadmill. Thus, the seat and treadmill assembly allows the infant to practice walking or otherwise exercise while simultaneously changing its field of view to thereby better interact with the surrounding environment.

In one embodiment, the frame is in the form of an annular tray having a centrally located opening, the infant seat being positioned in the opening of the tray. The tray is immovably maintained above a support surface, such as a floor, by a plurality of legs depending downwardly from the tray. Anti-skid means on the legs inhibits the tray from moving relative to the support surface. By rendering it substantially immobile, the exerciser is safer than the mobile prior art baby walkers which, due to their mobility, can be hazardous for the reasons discussed above.

In order to permit the infant to rotate the seat and treadmill assembly, the tray is provided with an inner circular ridge positioned such that it can be gripped by the infant. An outer circular ridge is positioned on the tray such that someone other than the infant can grip the ridge and rotate the seat and treadmill assembly for the infant.

The treadmill includes a pair of spaced rollers and an endless belt extending around the rollers. Each roller is vertically adjustable such that the position of the treadmill can be varied to accommodate children of different sizes. Moreover, the angle of inclination of the treadmill can be adjusted to simulate either an uphill or downhill slope.

BRIEF DESCRIPTION OF THE DRAWINGS

For a more complete understanding of the present invention, reference is made to the following detailed description of an exemplary embodiment considered in conjunction with the accompanying drawings, in which.

DESCRIPTION OF THE EXEMPLARY EMBODIMENT

Figure 1:
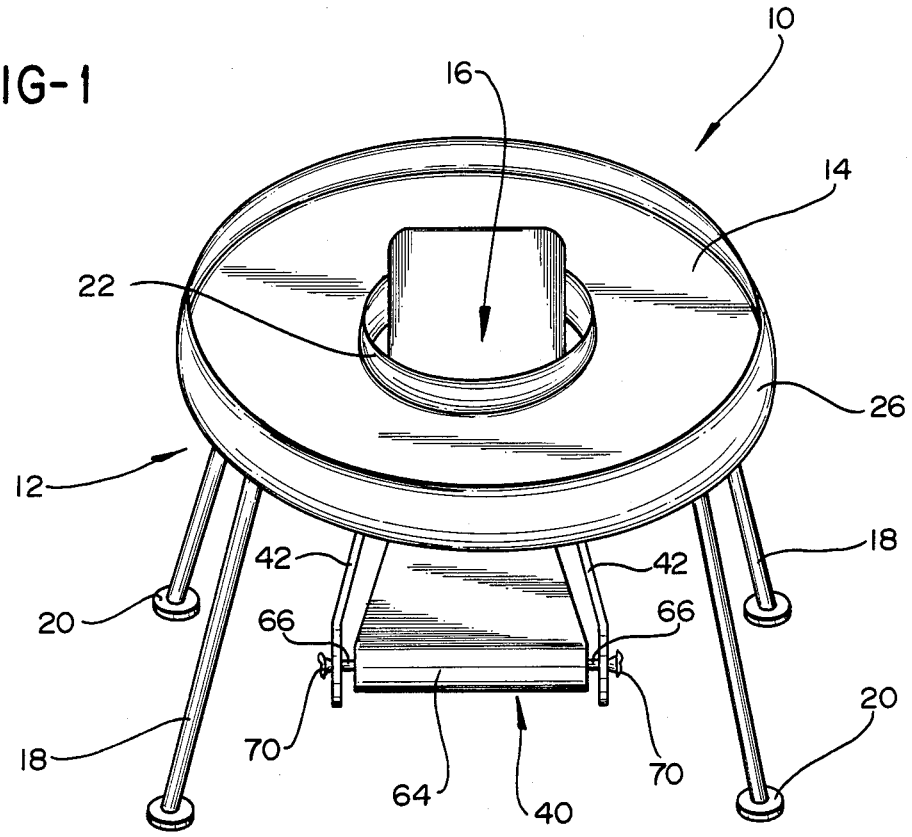
FIG. 1 is a front perspective view of an infant exerciser constructed in accordance with one exemplary embodiment of the present invention.
Figure 3:
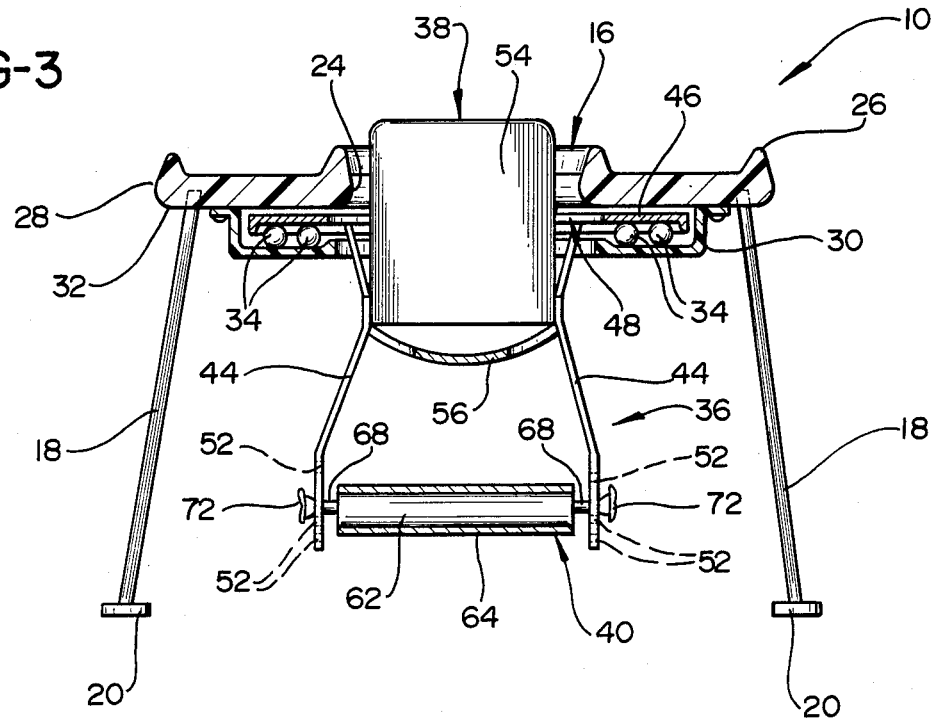
FIG. 3 is a cross-sectional view, taken along line III—III of FIG. 2 and looking in the direction of the arrows, of the infant exerciser illustrated in FIG. 2.

Referring to FIGS. 1–5, an infant exerciser 10 includes a frame 12 in the form of an annular tray 14 having a centrally located opening 16 therein. Legs 18 depend from the tray 14 so as to maintain the tray 14 in a substantially horizontal orientation above a floor or other support surface. Each of the legs 18 is equipped with non-skid pads or feet 20 in order to inhibit the accidental or inadvertent movement of the frame 12 across the floor or other support surface. The legs 18 may be releaseably fastened to the tray 14 by conventional fastening means (not shown) to allow for simple and rapid assembly and disassembly, thereby facilitating storage and transportation of the exerciser 10.

The tray 14 has an inner circular ridge 22 which extends upwardly from an inner circumferential edge 24 of the tray 14 for a purpose to be described hereinafter. An outer circular ridge 26 extends upwardly from an outer circumferential edge 28 of the tray 14 for a purpose to be described hereinafter. Such items as baby toys, food and books can be placed on the tray 14 between the inner ridge 22 and the outer ridge 26.

An annular roller bearing race 30 is attached to a bottom surface 32 of the tray 14. The bearing race 30 houses two concentric rows of ball bearings 34 for a purpose to be described hereinafter.

A seat and treadmill assembly 36 is rotatably mounted relative to the tray 14 such that the seat and treadmill assembly 36 can be rotated 360°. More particularly, the seat and treadmill assembly 36 includes a seat 38 positioned in the opening 16 of the tray 14 and a treadmill 40 positioned below the seat 38. Front brackets 42 (see FIGS. 1 and 4) and rear brackets 44 (see FIGS. 3 and 4) depend downwardly from an annular collar 46 (see FIGS. 2–4) which extends into the bearing race 30 in rolling engagement with the ball bearings 34. An opening 48 in the collar 46 permits the seat 38 to extend therethrough. The front brackets 42 and the rear brackets 44 are provided with holes 50, 52, respectively, for a purpose to be described hereinafter.

The seat 38 itself includes a substantially rigid backrest 54 adapted to support the back of an infant and a flexible strap 56 adapted to support the infant's buttocks and crotch while permitting the infant's legs to straddle the strap 56 on opposite sides thereof. More particularly, the backrest 54 is mounted between the rear brackets 44, while the strap 56 extends from a lower end 58 (see FIG. 4) of the backrest 54 to the collar 46.

Figure 4:
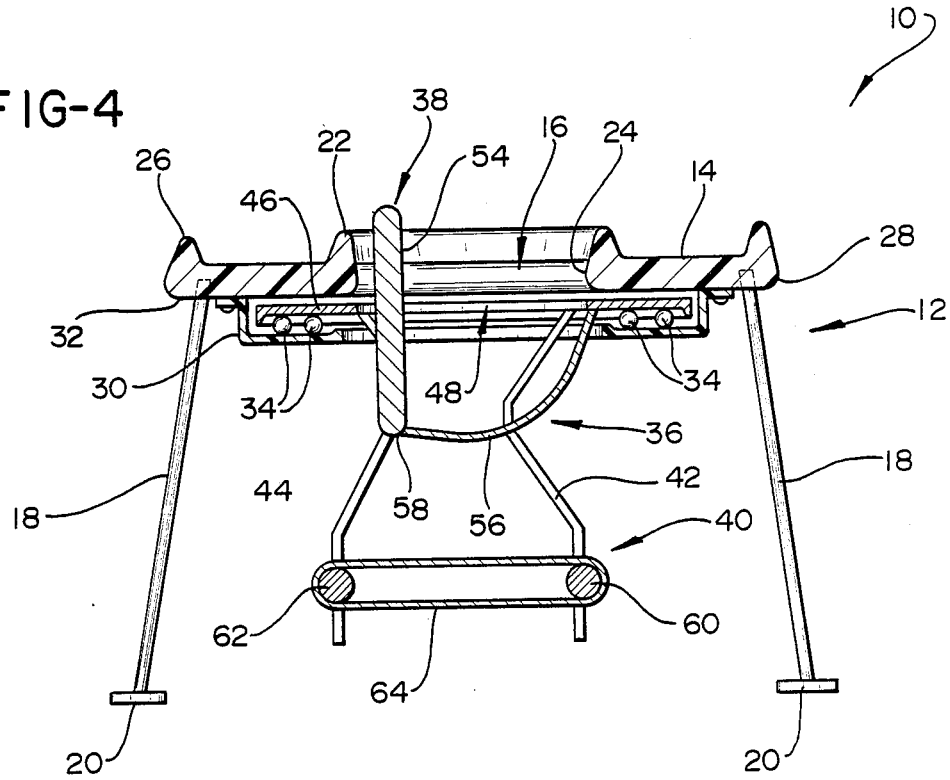
FIG. 4 is a cross-sectional view, taken along line IV—IV of FIG. 2 and looking in the direction of the arrows, of the infant exerciser illustrated in FIG. 2.
Figure 2:
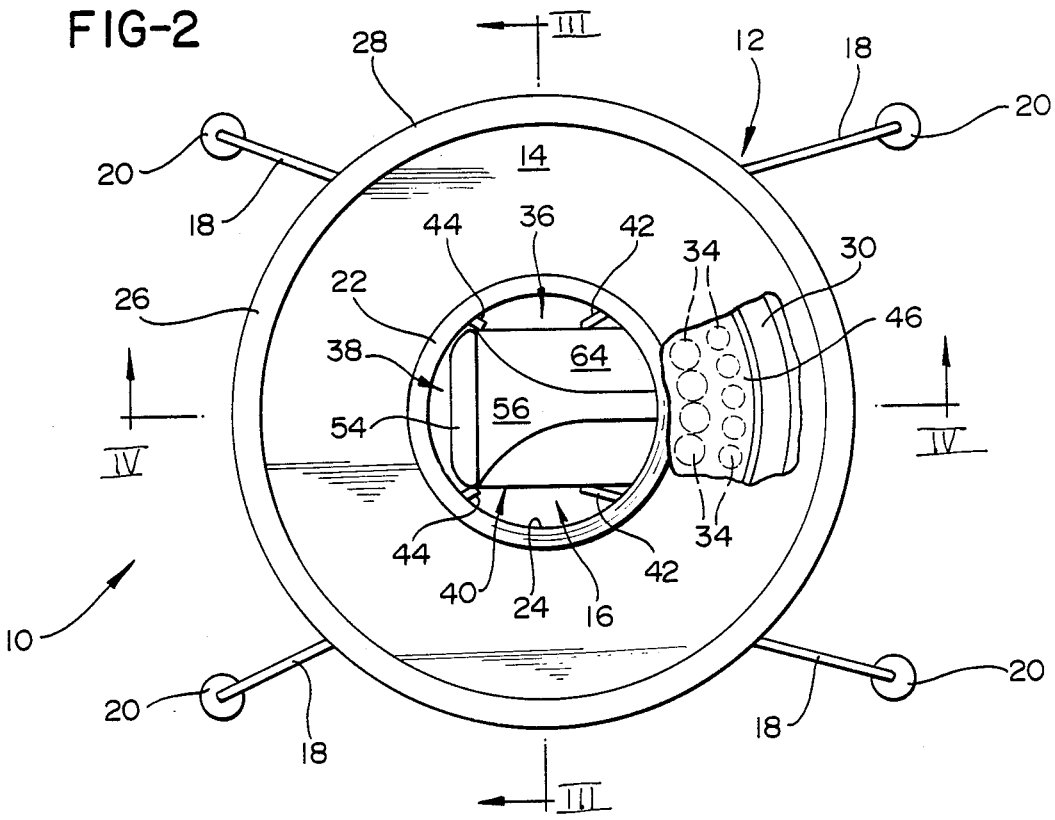
FIG. 2 is a top plan view of the infant exerciser illustrated in FIG. 1, a portion of the exerciser being broken away to facilitate consideration and discussion.
Figure 5:
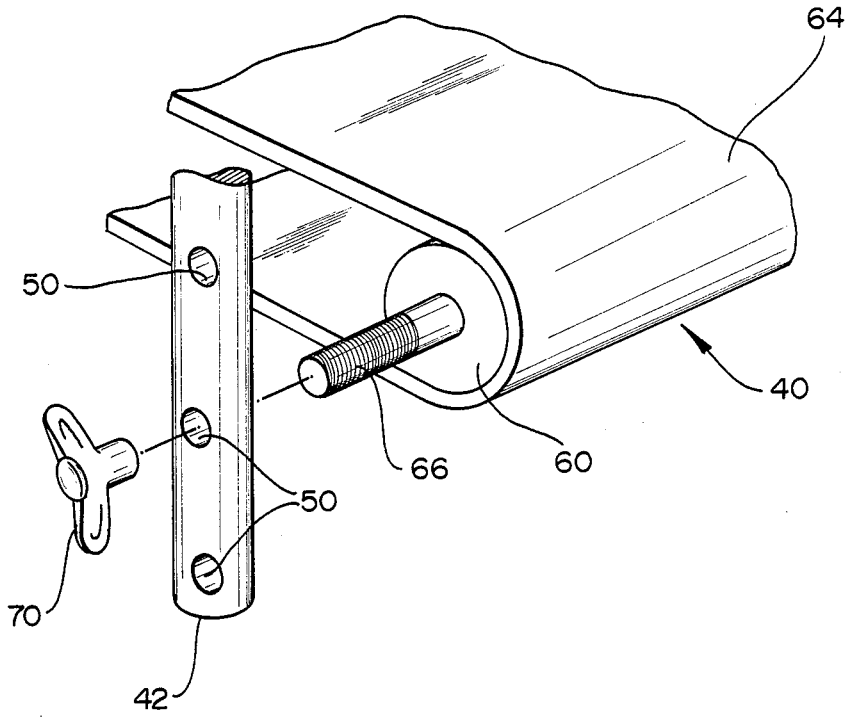
FIG. 5 is an exploded perspective view showing, in detail, a portion of the infant exerciser illustrated in FIGS. 1–4.

The treadmill 40 includes a front roller 60, a rear roller 62 and an endless belt 64 trained around the rollers 60, 62 (see FIG. 4). The front roller 60 has an axle 66 (see FIGS. 1 and 5) which is removably received in a corresponding pair of the holes 50 in the front brackets 42. Similarly, the rear roller 62 has an axle 68 (see FIG. 3) which is removably received in a corresponding pair of the holes 52 in the rear brackets 44. With the front roller 60 removably secured between the front brackets 42 by wing nuts 70 (see FIGS. 1 and 5), which threadedly engage opposite ends of the axle 66, and the rear roller 62 removably secured between the rear brackets 44 by wing nuts 72 (see FIG. 3), which threadedly engage opposite ends of the axle 68, the treadmill 40 is positioned such that the infant's feet contact the endless belt 64, whereby the infant can walk on the treadmill 40. Depending upon which of the holes 50 receive the axle 66 of the front roller 60 and which of the holes 52 receive the axle 68 of the rear roller 62, the vertical position of the treadmill 40 can be varied to thereby accommodate infants of different sizes. Also, the holes 50, 52 in the brackets 42, 44, respectively, permit the angle of inclination of the treadmill 40 to be varied, whereby the treadmill 40 can simulate either an uphill slope or a downhill slope.

In use, an infant is placed in the seat 38 of the seat and treadmill assembly 36. With the treadmill 40 positioned such that the infant's feet contact the endless belt 64, the belt is free to walk on the treadmill 40. Although such walking action rotates the endless belt 64, the execiser 10 remains substantially stationary because the legs 18 immovably engage the floor or other support surface. As the infant walks or otherwise exercises on the treadmill 40, he or she can grip the inner ridge 22 of the tray 14 and rotate the seat and treadmill assembly 36 relative to the frame 12, thereby permitting the infant to better interact with its surrounding environment. Alternatively, someone other than the infant can grip the outer ridge 26 of the tray 14 and rotate the seat and treadmill assembly 36 for the infant. In either case, such rotation of the seat and treadmill assembly 36 is facilitated by the ball bearings 34.

It will be understood that embodiment described herein is merely exemplary and that a person skilled in the art may make many variations and modifications without departing from the spirit and scope of the invention. All such variations and modifications are intended to be included within the scope of the invention as defined by the appended claims.

I claim:

1. An infant exerciser adapted for use in a substantially stationary location, comprising a frame having an opening therein; mounting means for mounting said frame above a support surface such that said frame is maintained in a substantially horizontal orientation and is substantially immovable relative to the support surface; supporting means for supporting an infant above the support surface with its legs above and out of engagement with the support surface, said supporting means including a seat positioned in said opening in said frame and sized and shaped so as to permit the infant to sit thereon and a treadmill positioned below said seat such that the infant can walk on said treadmill; inhibiting means for inhibiting the movement of said mounting means relative to the support surface, whereby the infant can practice walking or otherwise exercise its legs on said treadmill without actually moving said exerciser along the support surface; and suspending means for suspending said supporting means from said frame such that said seat and said treadmill are conjointly rotatable relative to said frame and hence relative to the support surface, whereby the infant can change its field of view to thereby better interact with the surrounding environment while continuing to walk or otherwise exercise its legs on said treadmill.

2. The infant exerciser of claim 1, wherein said frame includes first gripping means for permitting the infant to grip said frame so as to rotate said supporting means relative to said frame.

3. The infant exerciser of claim 2, wherein said frame includes second gripping means for permitting someone other than the infant to grip said frame so as to rotate said supporting means relative to said frame.

4. The infant exerciser of claim 3, wherein said frame is an annular tray, said opening being centrally located in said tray.

5. The infant exerciser of claim 4, wherein said first gripping means includes an inner circular ridge extending upwardly from said tray.

6. The infant exerciser of claim 5, wherein said inner ridge extends upwardly from an inner circumferential edge of said tray.

7. The infant exerciser of claim 5, wherein said second gripping means includes an outer circular ridge extending upwardly from said tray.

8. The infant exerciser of claim 7, wherein said outer ridge extends upwardly from an outer circumferential edge of said tray.

9. The infant exerciser of claim 1, wherein said supporting means includes adjusting means for adjusting the distance between said seat and said treadmill, whereby said exerciser can accommodate infants of different sizes.

10. The infant exerciser of claim 9, wherein said adjusting means also permits the angle of inclination of said treadmill to be adjusted.

11. The infant exerciser of claim 10, wherein said treadmill includes a first roller, a second roller and an endless belt trained around said first and second rollers.

12. The infant exerciser of claim 11, wherein said supporting means further includes a first pair of brackets, said first roller being rotatably supported between said brackets of said first pair of brackets, and a second pair of brackets, said second roller being rotatably supported between said brackets of said second pair of brackets.

13. The infant exerciser of claim 12, wherein said adjusting means includes a first set of holes provided in each bracket of said first pair of brackets, each hole of said first set of holes being sized and shaped so as to removably receive an axle of said first roller, and a second set of holes provided in each bracket of said second pair of brackets, each hole of said second set of holes being sized and shaped so as to removably receive an axle of said second roller.

14. The infant exerciser of claim 1, wherein said suspending means includes at least one roller bearing race positioned between said frame and said supporting means, whereby said supporting means rolls as it rotates relative to said frame.

15. The infant exerciser of claim 1, wherein said mounting means includes a plurality of legs extending rigidly from said frame to the support surface.

16. The infant exerciser of claim 15, wherein said inhibiting means includes an anti-skid pad provided on each of said legs.

17. The infant exerciser of claim 1, wherein said supporting means is rotatable in an arc of 360°.

18. An infant exerciser adapted for use in a substantially stationary location, comprising an annular tray having a centrally located opening therein; a plurality of legs depending from said tray so as to support said tray above a support surface such that said tray is maintained in a substantially horizontal orientation and is substantially immovable relative to the support surface; supporting means for supporting an infant above the support surface with its legs above and out of engagement with the support surface, said supporting means including a seat positioned in said opening in said tray and sized and shaped so as to permit the infant to sit thereon and a treadmill positioned below said seat such that the infant can walk on said treadmill; inhibiting means for inhibiting the movement of said exerciser relative to the support surface, whereby the infant can practice walking or otherwise exercise its legs on said treadmill without actually moving said exerciser along the support surface; suspending means for suspending said supporting means from said tray such that said seat and said treadmill are conjointly rotatable relative to said tray and hence relative to the support surface, whereby the infant can change its field of view to thereby better interact with the surrounding environment while continuing to walk or otherwise exercise its legs on said treadmill; first gripping means provided on said tray for permitting the infant to grip said tray so as to rotate said supporting means relative to said tray; second gripping means provided on said tray for permitting someone other than the infant to grip said tray so as to rotate said supporting means relative to said tray; and adjusting means for adjusting the distance between said seat and said treadmill, whereby said exerciser can accommodate infants of different sizes.

19. The infant exerciser of claim 18, wherein said first gripping means includes an inner circular ridge extending upwardly from an inner circumferential edge of said tray and said second gripping means includes an outer circular ridge extending upwardly from an outer circumferential edge of said tray.

20. The infant exerciser of claim 18, wherein said adjusting means also permits the angle of inclination of said treadmill to be adjusted.

21. The infant exerciser of claim 20, wherein said treadmill includes a first roller, a second roller and an endless belt trained around said first and second rollers.

22. The infant exerciser of claim 21, wherein said supporting means further includes a first pair of brackets, said first roller being rotatably supported between said brackets of said first pair of brackets, and a second pair of brackets, said second roller being rotatably supported between said brackets of said second pair of brackets.

23. The infant exerciser of claim 22, wherein said adjusting means includes a first set of holes provided in each bracket of said first pair of brackets, each hole of said first set of holes being sized and shaped so as to removably receive an axle of said first roller, and a second set of holes provided in each bracket of said second pair of brackets, each hole of said second set of holes being sized and shaped so as to removably receive an axle of said second roller.

24. The infant exerciser of claim 23, wherein said suspending means includes at least one roller bearing race positioned between said tray and said supporting means, whereby said supporting means rolls as it rotates relative to said tray.

25. The infant exerciser of claim 24, wherein said supporting means is rotatable in an arc of 360°.

26. The infant exerciser of claim 25, wherein said inhibiting means includes an anti-skid pad provided on each of said legs.

* * * * *